US006071025A

United States Patent [19]

Shoki

[11] Patent Number: 6,071,025

[45] Date of Patent: Jun. 6, 2000

[54] PRINTER SYSTEM HAVING TWO OR MORE INK CARTRIDGES

[75] Inventor: Mikio Shoki, Daito, Japan

[73] Assignee: Funai Electric Co., Ltd., Osaka, Japan

[21] Appl. No.: 09/241,993

[22] Filed: Feb. 2, 1999

[30] Foreign Application Priority Data

Feb. 5, 1998 [JP] Japan ..... 10-24122

[51] Int. Cl.[7] ..... B41J 31/00

[52] U.S. Cl. ..... 400/191; 400/207; 400/74; 400/211

[58] Field of Search ..... 400/191, 206, 400/207, 211, 320, 320.1, 74, 149, 279; 347/14, 19, 37, 43

[56] References Cited

U.S. PATENT DOCUMENTS

| | | | |
|---|---|---|---|
| 5,082,381 | 1/1992 | Kishida et al. | 400/211 X |
| 5,297,017 | 3/1994 | Haselby et al. | 347/19 |
| 5,751,449 | 5/1998 | Nobuta | 347/43 X |
| 5,828,389 | 10/1998 | Yamaguchi et al. | 347/14 X |
| 5,903,285 | 5/1999 | Ju et al. | 347/5 |

FOREIGN PATENT DOCUMENTS

| | | |
|---|---|---|
| 0 374 762 A2 | 6/1990 | European Pat. Off. . |
| 0 440 438 A2 | 1/1991 | European Pat. Off. . |
| 0 540 245 A2 | 10/1992 | European Pat. Off. . |
| 0 622 236 A2 | 4/1994 | European Pat. Off. . |
| 1-120974 | 8/1989 | Japan . |
| 04225779 | 8/1992 | Japan . |
| 6-155758 | 6/1994 | Japan . |
| 9-69921 | 3/1997 | Japan . |
| 2317589 | 4/1998 | United Kingdom . |

*Primary Examiner*—John S. Hilten
*Assistant Examiner*—Minh Chau
*Attorney, Agent, or Firm*—Lackenbach Siegel Marzullo Aronson & Greenspan, P.C.

[57] ABSTRACT

A printer system includes a printer on which color and monochromatic print cartridges are mounted, and a personal computer to output bit map data to the printer. The kinds of these ink cartridges are memorized as status information within a RAM so that the personal computer can detect a cartridge mounted position based on the status information. In the case that the color and/or monochromatic print cartridge is mounted incorrect, the personal computer detects an amount of a difference from a normal mount position to cause print data to shift depending upon the difference, thus creating bit map data.

3 Claims, 7 Drawing Sheets

PRINTER SYSTEM HAVING TWO OR MORE INK CARTRIDGES

BACKGROUND OF THE INVENTION

1. Field of the Invention

The present invention relates to printer systems, and more particularly to a printer system having, for example, two or more ink cartridges.

2. Description of the Prior Art

There is one example of prior art of this kind disclosed on Mar. 11, 1998 in Japanese Patent Laying-open No. H9-69921 [H04N 1/23, B41J 2/21, B41J 2/01, B41J 25/34, G06F 3/12]. According to this art, a recording device and a facsimile apparatus using that recording device have such a structure that, in the case that an ink cartridge is incorrectly mounted, a message is displayed on the LCD or the like asking for an exchange of the ink cartridge.

This prior art, however, has required the remounting of the ink cartridge that has been incorrectly mounted. Due to this, there has been a fear that the cartridge might suffer damage or encounter ink leakage when remounting the cartridge, in addition to troublesome labor and time imposed on the user.

SUMMARY OF THE INVENTION

Therefore, it is a primary object of the present invention to provide a novel printer system.

It is another object of the present invention to provide a printer system which does not require remounting in the case that an ink cartridge is mounted incorrect.

A printer system according to the present invention comprises: a carrier having a first position in which a first ink cartridge is held and a second position in which a second ink cartridge is held; an incorrect amount detecting means for detecting that at least one of the first ink cartridge and the second ink cartridge is held in an incorrect position; and a control means for controlling print operation depending upon detection by the detecting means.

Specifically, the control means includes a difference detecting means for detecting a difference between a normal mounting position and an incorrectly mounted position of the at least one of the first ink cartridge and the second ink cartridge, and a correcting means for correcting a print position depending upon the difference.

In correcting a print position, it is possible to utilize a method to correct print data or correct a print start position. That is, the correcting means includes a print data correcting means for correcting print data and a position correcting means.

In the case of correcting the print data, a data shift means shifts the print data depending on the difference.

For example, where the incorrect mounting detecting means includes a first detecting means to detect first incorrect mounting wherein the first ink cartridge is held in the second position, and a second detecting means to detect second incorrect mounting wherein the second ink cartridge is held in the first position, the data shift means should include a first shift means to cause the print data to shift in a first direction when the first incorrect mounting is detected by the first detecting means, and a second shift means to cause the print data to shift in the second direction when the second incorrect mounting is detected by the second detecting means.

Similarly, where correcting a print start position, the position correcting means should include a first position changing means to chance the print start position in a first direction when the first incorrect mounting is detected by the first detecting means, and a second position changing means to change the print start position in the second direction when the second incorrect mounting is detected by the second detecting means.

Incidentally, when changing a print start position by the first position changing means and the second position changing means, the print start position may be changed in its address. In the case that a carrier motor hereinafter referred to is a DC motor, the "address" herein may be positional information (address) given by an output pulse from an encoder provided to the DC motor. If the carrier motor is a stepping motor, the positional information (address) may be a count value obtained by counting the number of steps in the stepping motor.

That is, in the present invention, when two cartridges are mounted on the carrier and then a print start command is given, detection is made on the respective ink cartridges of their kinds. In the case that the ink cartridge is incorrectly mounted, print data is shifted or otherwise a print start position is corrected depending upon a difference between a normal mounted position and an incorrectly mounted position.

According to the present invention, even if the ink cartridge is mounted incorrectly, printing can be carried out without requiring that the cartridge be remounted.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
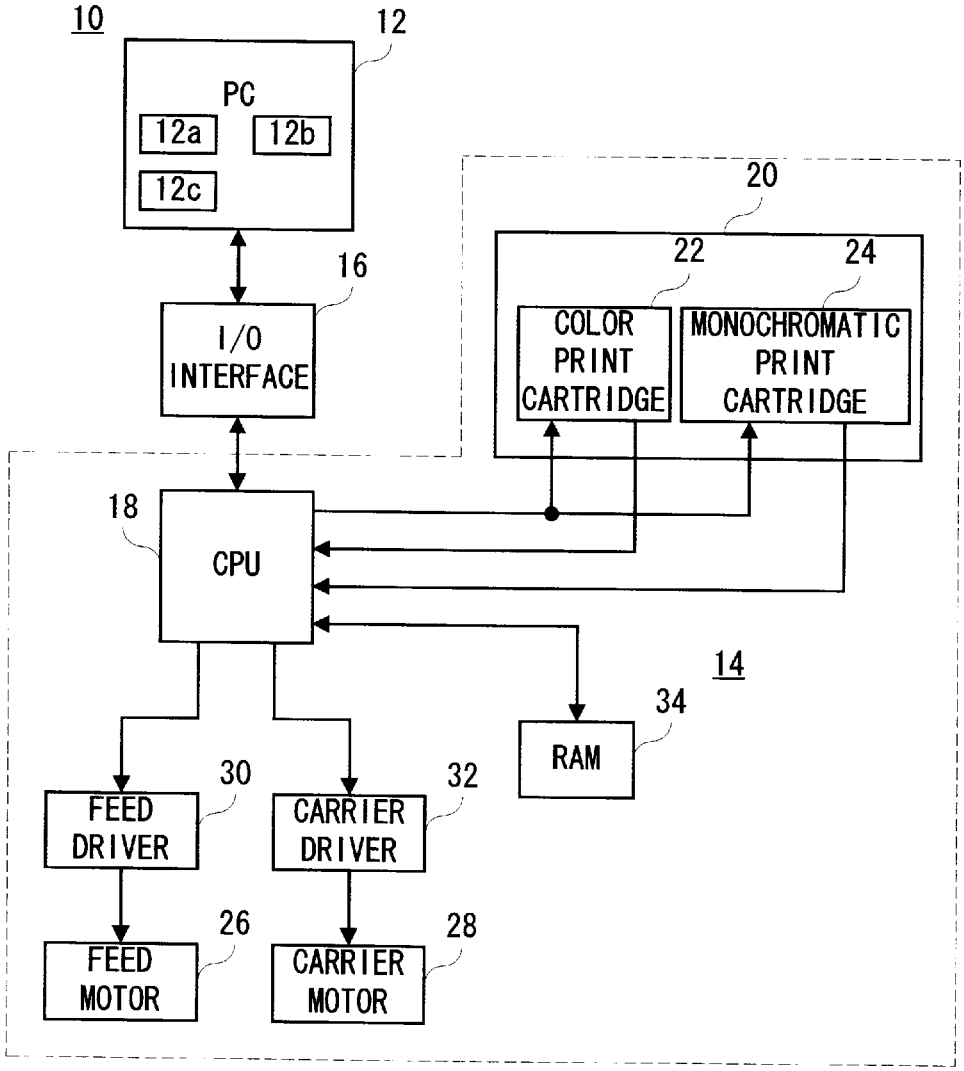
FIG. 1 is a block diagram showing one embodiment of the present invention.

Referring to FIG. 1, a printer system 10 in this embodiment includes a PC (Personal Computer) 12 as a host machine. The PC 12 is connected through an I/O interface 16 to a printer 14. That is, the PC 12 is connected to a CPU 18 of the printer 14 through the I/O interface 16, thereby enabling communication between the PC 12 and the CPU 18. The CPU 18 is also connected to an ink cartridge mounted on a carrier 20 via a parallel-connected signal line. In this embodiment the carrier 20 can can have two ink cartridges mounted thereon. In the case where ink cartridges have been mounted in normal mounting positions, a color print cartridge 22 is positioned at the left in the carrier 20 while a monochromatic print cartridge 24 is positioned at the right.

The printer 14 also includes a feed motor 26 and a carrier motor 28. The feed motor 26 and the carrier motor 28 are respectively driven by a feed driver 30 and a carrier driver 32. Drive pulses are supplied from the CPU 18 to the feed driver 30 and the carrier driver 32. Based on the drive pulse the feed driver 30 creates a drive voltage to the feed motor 26, while the carrier driver 32 creates a drive voltage to the carrier motor 28. Accordingly, the carrier 20 can be moved in carriage and feed directions.

The printer 14 further includes a RAM 34, and the RAM 34 is memorized with status information about the printer. This status information is read out by the CPU 18 according to a request from the PC 12, and delivered to the PC 12 through the I/O interface 16.

Given a print start command, the CPU 18 supplies a serial clock to each ink cartridge. In response to this serial clock, an ID is supplied to the CPU 18 which represents an assigned kind of an ink cartridge to each ink cartridge. With this ID the CPU 18 supplies a serial clock (a signal to ask for ID transmission) to the ink cartridge through an electric connector provided on the carrier 20. On a side of each ink cartridge is of course provided a connector to be connected to the above-stated connector on the carrier 20. Responsive to this serial clock, an ID (Identification Number) representative of an ink cartridge kind assigned to the ink cartridge is transmitted to the CPU 18. Based on the ID the CPU 18 can detect as to where in the carrier 20 and which kind an ink cartridge is mounted. The kind thus detected is recorded as status information within the RAM 34. In the RAM 34 is recorded with status information including a reference position A of the carrier, a position B of the monochromatic print cartridge 24, a position C of a color print cartridge 22, a position D of print start, a current state of the printer 14 (e.g., an in-print state or print standby state) and an absolute position of the carrier 20, in addition to the kinds of the ink cartridges. That is, if the carrier reference position A is set by an address (0×00), the positions B and C for the carrier 20 positioned at a right end of the printer 14 as well as the print start position D are given by address information. The status information is read out of the RAM 34 by the CPU 18 according to a request from the PC 12, and sent to the PC 12 through the I/O interface 16. The PC 12 detects a mounting situation of the ink cartridge from the status information, and stores bit map the print data in accordance with the mounting situation. When a monochromatic print cartridge 24 is being used, the bit map data of print data is stored into a memory 12*a*. Where a color print cartridge 22 is being used, the bit map data for each color, i.e., yellow, cyan and magenta, is stored into memories 12*a*, 12*b* and 12*c*.

Figure 2:
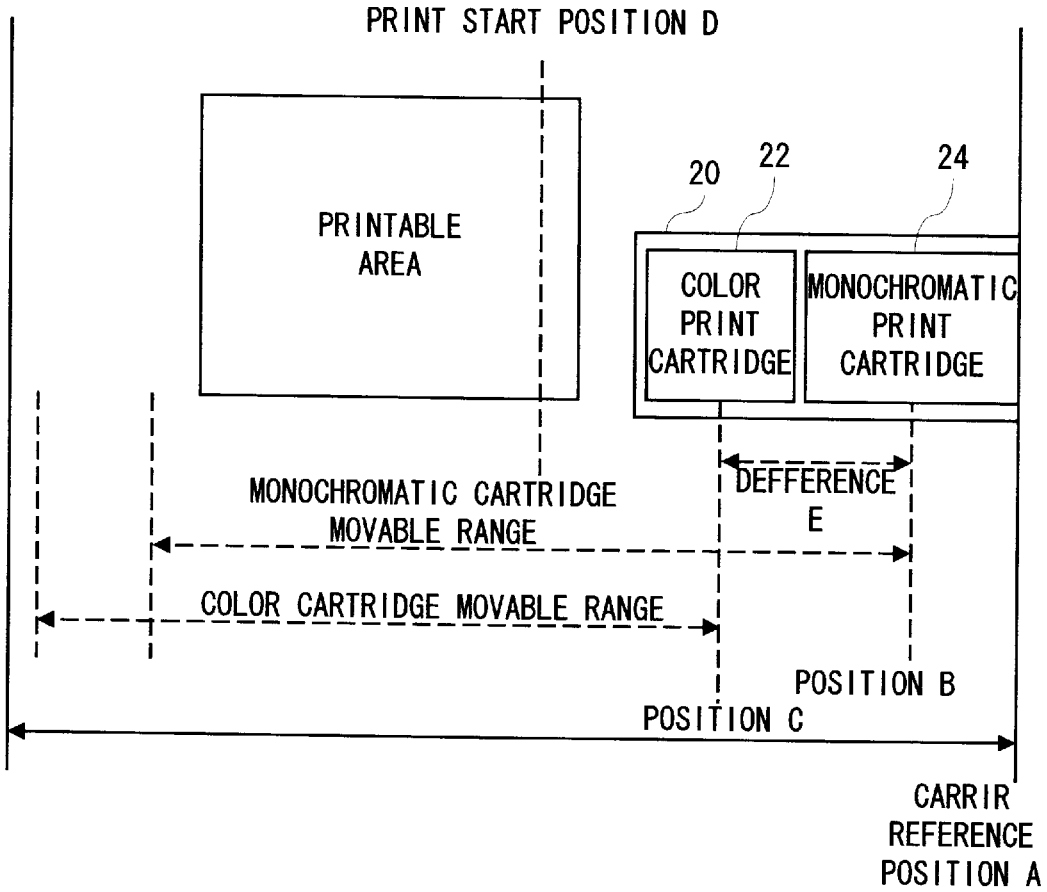
FIG. 2 is an illustrative view showing an ink cartridge moving range and a print start position in the FIG. 1 embodiment.

For example, where the ink cartridges are mounted at normal mount positions as shown in FIG. 2, the PC 12 stores as it is the bit map data of the print data. The PC 12 then converts the bit map data into nozzle data (print data) matched to the arrangement of nozzles (not shown) provided on the ink cartridge. This nozzle data is outputted 1 bit by 1 bit to the CPU 18.

Figure 3:
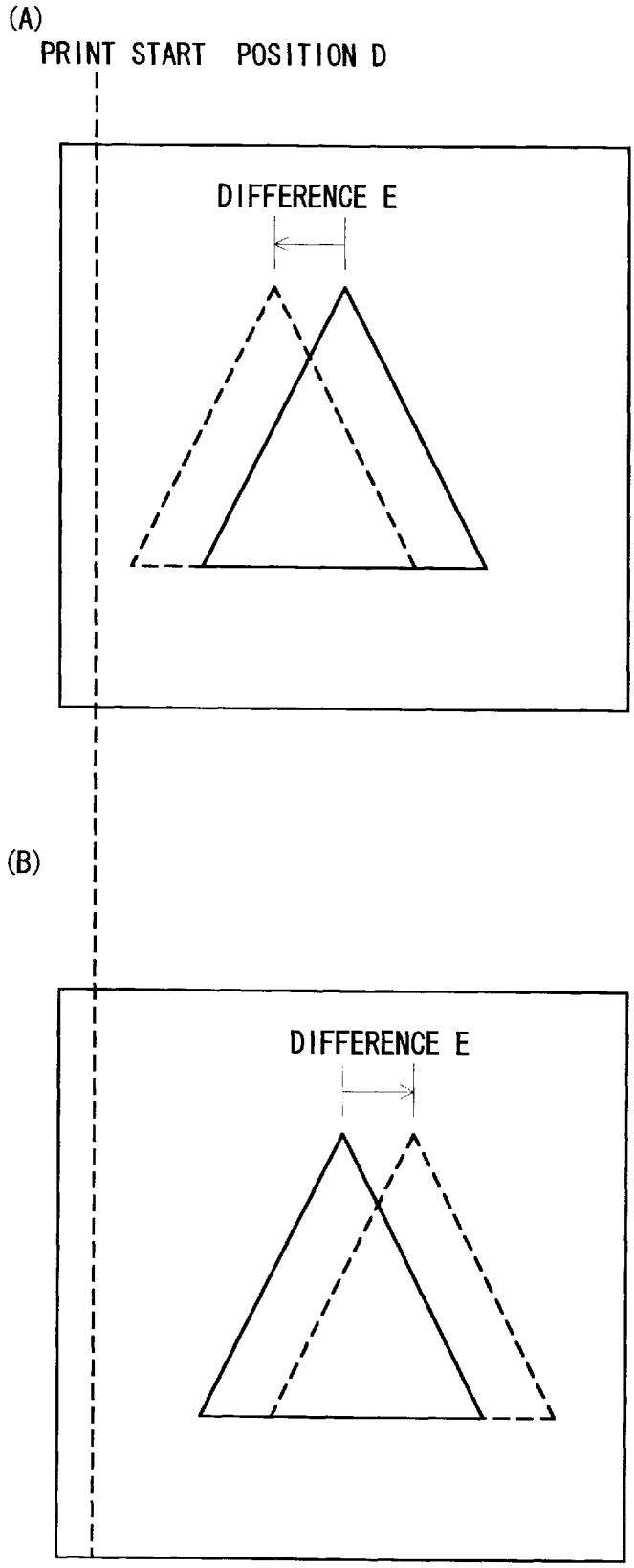
FIG. 3 is an illustrative view showing bit map data stored in a PC (Personal Computer) given in the FIG. 1 embodiment in an event of mounting an ink cartridge by mistake.

Meanwhile, if the color print cartridge 22 and monochromatic print cartridge 24 are mounted incorrect, the PC 12 detects a difference E between a currently mounted position (incorrectly mounted position) and a normal mounting position. That is, the difference E is detected from an address of the position B and an address of the position C in the status information. Incidentally, the difference E is a value previously determined on the basis of mechanism design. The difference E is detected depending upon a position that the ink cartridge is being mounted. Accordingly, the PC 12 makes a correction using the difference E to the print data thereby storing the bit map data. That is, when the ink cartridge to be used is a monochromatic print cartridge 24, the distance to the print start position D is decreased by the amount of the difference E. Consequently, the PC 12 shifts the position of to the print data by the amount of the difference E toward the print start position D in storing the bit map data, as shown in FIG. 3(A). Conversely, when a color print cartridge 22 is used, the distance to the print start position D is increased by the amount of the difference E. The PC 12 gives shifting in position to the print data by the amount of the difference E in a direction away from the print start position D to store the bit map data, as shown in FIG. 3(B). The bit map data is then converted into nozzle data, in a manner as stated before, for output to the CPU 18.

Figure 4:
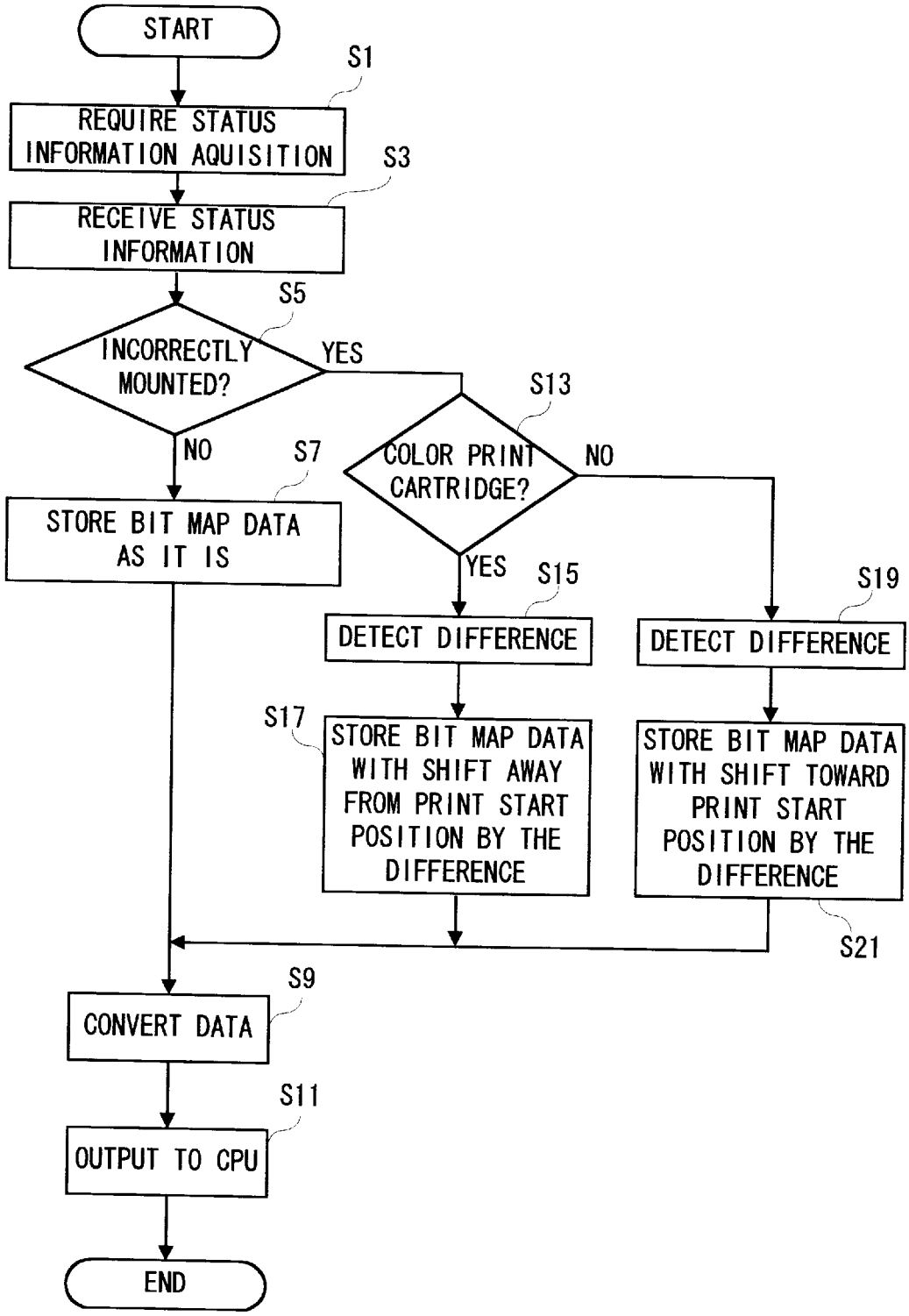
FIG. 4 is a flowchart showing part of a process by PC given in the FIG. 1 embodiment.

According to this embodiment, if an ink cartridge is incorrectly mounted, it is possible to carry out printing by correcting bit map data without remounting the cartridge. The above operation is carried out by the PC 12 according to a flowchart shown in FIG. 4, and by the CPU 18 according to a flowchart shown in FIG. 5. As shown in FIG. 4, if given a print command the PC 12 starts processing. In step S1 the PC12 outputs a demand to acquire status information. Subsequently in step S3 the PC 12 receives the status information. In step S5 it is determined whether the ink cartridge is mounted incorrectly or not. If "NO" here, that is, if mounted in the normal mounting position, the bit map data is stored as it is in step S7. In step S9 the bit map data is converted into nozzle data, and in step S11 the nozzle data is outputted to the CPU 18. ending the process.

On the other hand, if "YES" in step 5, that is, if incorrectly mounted, it is determined in step S13 whether a color print cartridge 22 is to be used or not. If "YES" here, then in step S15 a difference E is detected from the currently mounted position (incorrectly mounted position) address and the normal mounting position address. In step S17 print data is shifted by the amount of the difference E away from a print start position D, and the bit map data is stored, advancing the process to step S9. On the other hand, if "NO" in step S13, that is, if a monochromatic print cartridge 24 is to be used, a difference E is detected in step S19 from the currently mounted position (incorrectly mounted position) address and the normal mounting position address. In step S21 print data is shifted by the difference E toward the print start position to store the bit map data, advancing the process to step S9.

Figure 5:
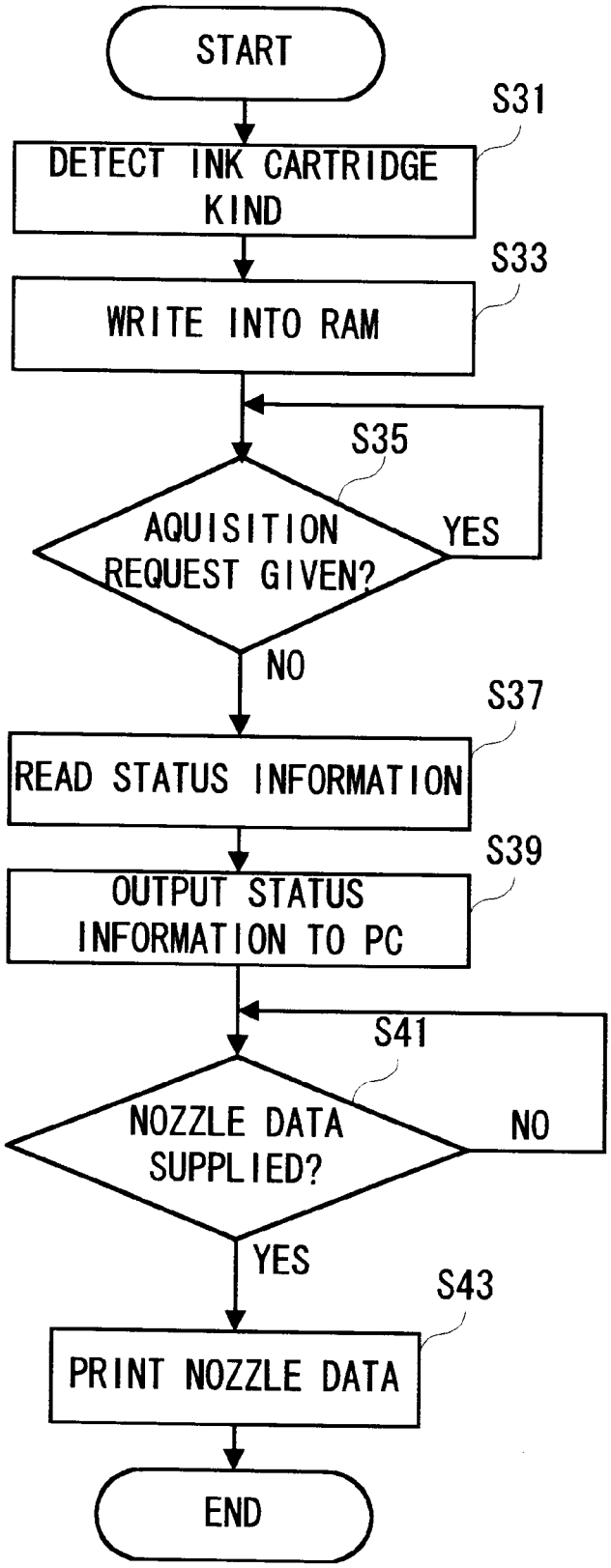
FIG. 5 is a flowchart showing part of a process by CPU given in the FIG. 1 embodiment.

As shown in FIG. 5, the CPU 18 starts the process upon receiving a print command. In step S31 the kind of ink cartridge is detected. Subsequently in step S33 the status information is written onto the RAM 34. In step S35 it is determined whether there is a demand to acquire status information from the PC 12 or not. If "NO" here, the process returns to step S35, while if "YES" the status information is read out of the RAM 34 in step S37. In step S39 the status information is outputted to the PC 12. Subsequently in step S41 it is determined whether data is given from the PC 12 or not. If "NO", the process returns to step S41, while if "YES" printing is made based on the nozzle data (print data) given in step S42, ending the process.

A printer system 10 of another embodiment is similar to the above-described embodiment except for correcting on the print start position D, omitting duplicated explanations.

In this printer system 10, if an ink cartridge is mounted incorrectly, the print start position D is corrected by the difference E of between the normal mounting position and the incorrectly mounted position. That is, when using a color print cartridge 22, the color print cartridge 22 is distant by an amount of the difference E to the print start position D. Accordingly, the CPU 18 is supplied with an address for the print start position D added by the difference E. Conversely, when using a monochromatic print cartridge, the distance to the print start position D is shorter by the amount of the difference E. Therefore the CPU 18 is supplied by an address of the print start position D subtracted by the difference E therefrom.

According to this embodiment, because correction is made on the print start position D, if an ink cartridge is incorrectly mounted, printing can be carried out without remounting the ink cartridge.

Figure 6:
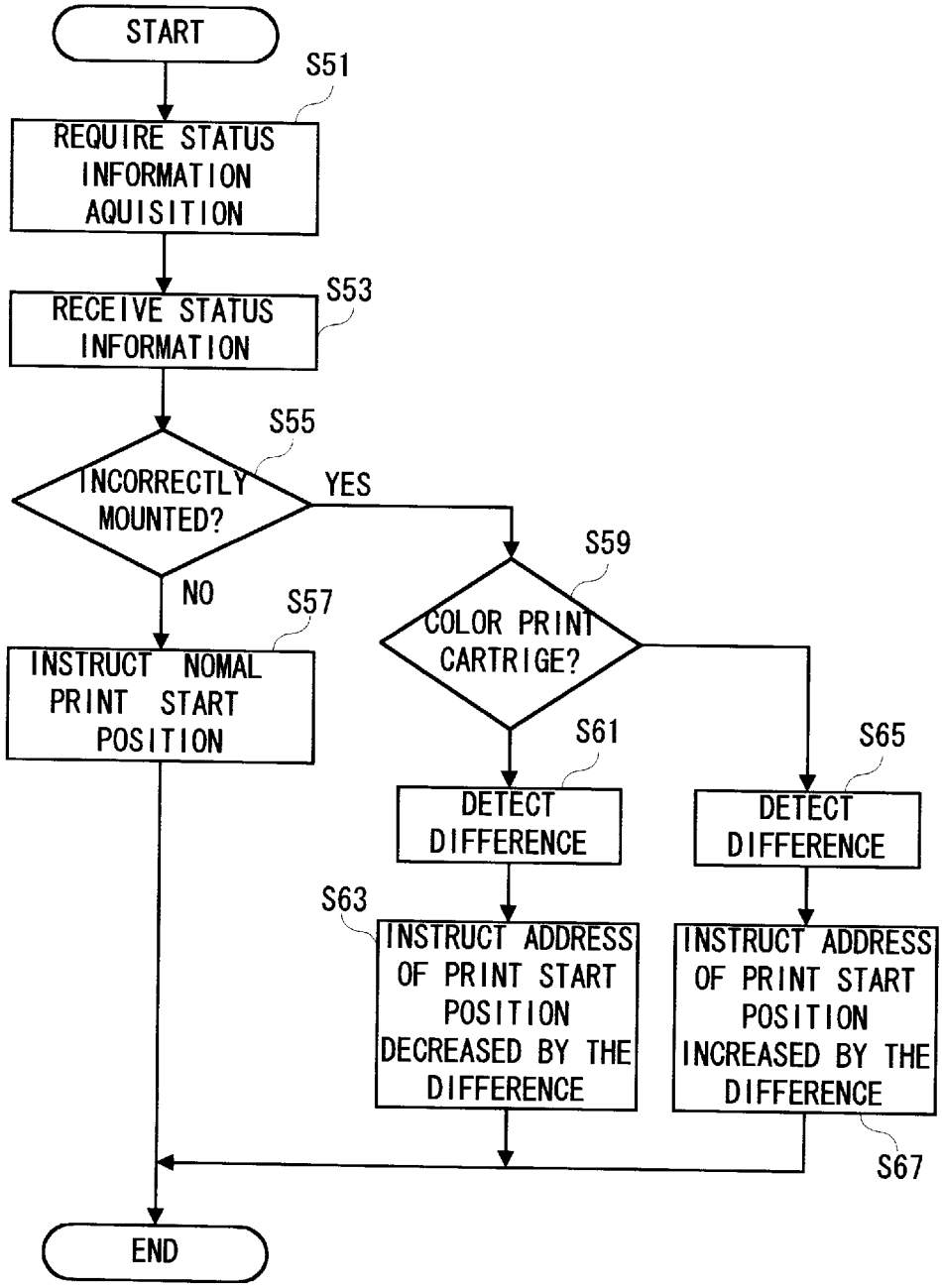
FIG. 6 is a flowchart showing part of a process by the PC in another embodiment.
Figure 7:
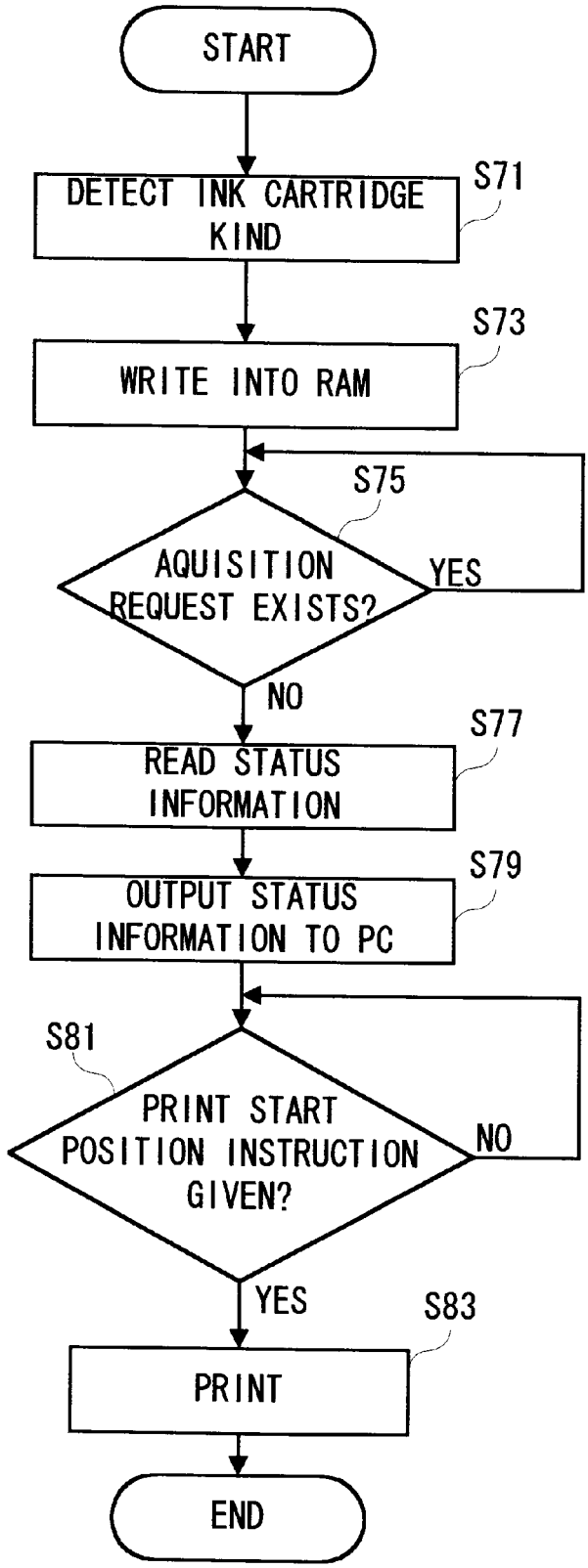
FIG. 7 is a flowchart showing part of a process by CPU in the other embodiment.

The above operation is carried out by the PC 12 according to a flowchart shown in FIG. 6, and by the CPU 18 according to a flowchart shown in FIG. 7.

As shown in FIG. 6, if a print command is given to the printer 14, the process is started. In step S51 a request is outputted to acquire status information. Subsequently in step S53 the status information is received, and in step S55 it is determined whether the ink cartridge is incorrectly mounted or not. If "NO" here, that is, if in the normal mounting position, then in step S57 an address for usual print start position D is instructed, ending the process. However, if "YES", it is determined in step S59 whether a color print cartridge 22 is to be used or not. If "YES" here, in step S61 detection is made on a difference E between the normal mounting position and the incorrectly mounted position. In step S63 an address of the print start position subtracted by the difference E therefrom is given to the CPU 18, ending the process. Meanwhile, if "NO" in step S59, that is, if a monochromatic print cartridge 24 is to be used, detection is made in step S65 on a difference between the normal mounting position and the incorrectly mounted position. In step S67 an address of the print start position D added by the difference E is given to the CPU 18, ending the process.

As shown in FIG. 7, if a print command is given the CPU 18 starts the process. In step S71 detection is made as to an inkjet kind. Subsequently in step S73 the status information is written onto the RAM 34. In step S75 it is determined whether there is a request to acquire status information from the PC 12 or not. If "NO" here, the process returns to step S75, while if "YES", in step S77 the status information is read out of the RAM 34, and in step S79 the status information is sent to the PC 12. Subsequently in step S81 it is determined whether an address (of the print start position D or corrected print start position D) has been given from the PC 12 or not. If "NO", the process returns to step S81, while if "YES", printing is effected according to the address given in step S83, ending the process.

Incidentally, in this embodiment a difference E is detected by the PC 12 to correct for the print start position D. However, the print start position D may be corrected by detecting a difference E by the CPU 18 without connecting the PC 12 to the printer 14, because the status information is being memorized in the RAM 34.

Also, these embodiment were explained on the case of using two ink cartridges. However, the above effects can be available when three or more ink cartridges are being mounted, if addresses for the ink cartridges are previously set.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer system comprising:

a carrier having a first position in which a first ink cartridge is held and a second position in which a second ink cartridge is held;

an incorrect mounting detecting means for detecting that a least one of the said first ink cartridge and said second ink cartridge is held in an incorrect position; and a control means for controlling print operation depending upon detection by said detecting means, said control means including a difference detecting means for detecting a difference between a normal mounting position and an incorrectly mounted position of the at least one of said first ink cartridge and said second ink cartridge, and a correcting means for correcting a print position depending upon the difference, said correcting means including a print data correcting means for correcting print data, said print data correcting means including a data shift means for causing the print data to shift in position, said incorrect mounting detecting means including a first detecting means for detecting first incorrect mounting wherein said first ink cartridge is held in said second position, and a second detecting means for detecting second incorrect mounting wherein said second ink cartridge is held in said first position, and said data shift means including a first shift means to cause the print data to shift in a first direction when the first incorrect mounting is detected by said first detecting means, and a second shift means to cause the print data to shift in the second direction when the second incorrect mounting is detected by second detecting means.

2. A printer system comprising:

a carrier having a first position in which a first ink cartridge is held and a second position in which a second ink cartridge is held;

an incorrect mounting detecting means for detecting that at least one of said first ink cartridge and said second ink cartridge is held in an incorrect position;

a control means for controlling print operation depending upon detection by said detecting means, said control means including a difference detecting means for detecting a difference between a normal mounting position and an incorrectly mounted position of the at least one of said first ink cartridge and said second ink cartridge, and a correcting means for correcting for a print position depending upon the difference, said correcting means including a position correcting means for correcting for a print start position depending upon the difference, and said incorrect mounting detecting means including a first detecting means for detecting first incorrect mounting wherein said first ink cartridge is held in said second position, and a second detecting means for detecting second incorrect mounting wherein said second ink cartridge is held in said first position, and said position correcting means including a first position changing means for changing the print start position in a first direction when the first incorrect mounting is detected by said first detecting means, and a second position changing means for changing the print start position in a second direction when the second incorrect mounting is detected by said second detecting means.

3. A printer system according to claim 2, wherein said first position changing means and said second position changing means respectively include address changing means.

* * * * *